United States Patent [19]

Gudnason

[11] Patent Number: 4,478,645

[45] **Date of Patent: * Oct. 23, 1984**

[54] PROCESS FOR THE PURIFICATION OF SUGAR SYRUPS

[75] Inventor: Geir V. Gudnason, Atlanta, Ga.

[73] Assignee: The Coca-Cola Company, Atlanta, Ga.

[ * ] Notice: The portion of the term of this patent subsequent to May 10, 2000 has been disclaimed.

[21] Appl. No.: 470,118

[22] Filed: Apr. 21, 1983

Related U.S. Application Data

[62] Division of Ser. No. 305,307, Sep. 24, 1981, Pat. No. 4,382,823.

[51] Int. Cl.[3] ..... C13D 3/00; C13D 3/02

[52] U.S. Cl. ..... 127/57; 127/48; 210/705

[58] Field of Search ..... 127/57, 46.1, 53, 13, 127/50, 48; 210/702, 705, 714, 727, 734, 710, 703, 704

[56] References Cited

U.S. PATENT DOCUMENTS

| | | | |
|---|---|---|---|
| 2,757,797 | 8/1956 | Eckert et al. | 210/703 |
| 3,166,442 | 1/1965 | Duke | 127/48 |
| 3,264,213 | 8/1966 | Pau et al. | 210/703 X |
| 3,479,221 | 11/1969 | Buhl | 127/46 |
| 3,539,393 | 11/1970 | Silva et al. | 127/48 X |
| 3,853,616 | 12/1974 | Rundell et al. | 127/57 X |
| 3,884,803 | 5/1975 | Taylor | 210/704 |
| 3,909,287 | 9/1975 | Rundell et al. | 127/57 |
| 3,926,662 | 12/1975 | Rundell et al. | 127/57 X |
| 4,076,552 | 2/1978 | Farag et al. | 127/50 |
| 4,081,288 | 3/1978 | Torres | 127/48 |
| 4,196,017 | 4/1980 | Melville et al. | 127/48 X |
| 4,207,185 | 6/1980 | Hinds | 210/703 |
| 4,288,551 | 9/1981 | Gudnason et al. | 127/57 X |

OTHER PUBLICATIONS

Meade-Chen "Cane Sugar Handbook" Tenth Edition, pp. 128, 129.

Tate and Lyle Engineering Ltd., "TALO Technology-A Summary of Processes, Products and Equipment."

*Primary Examiner*—Kenneth M. Schor

*Attorney, Agent, or Firm*—Eduardo M. Carreras

[57] ABSTRACT

A process for removing color, turbidity, flavor, and odor from impure, high Brix, sugar syrup involves entrapping the sugar impurities in an insoluble, primary calcium phosphate or aluminum hydroxide floc at about neutral pH, dividing the sugar syrup into a small portion and a large portion, aerating the small portion of the syrup at a specific Brix, recombining the small portion and the large portion, adding a polyelectrolyte to convert the primary floc into a secondary floc to which the air bubbles easily adhere and to cause flotation of said secondary floc, thus forming a scum mat at the top of the vessel. The purified sugar syrup is then filtered with or without activated carbon and small amounts of a filter aid to produce a sugar syrup with substantially reduced color, turbidity, flavor, and odor. The sugar in the scum is recovered by mixing it with water and allowing a second flotation to take place without any further aeration or chemicals addition.

19 Claims, No Drawings

PROCESS FOR THE PURIFICATION OF SUGAR SYRUPS

This is a division of application Ser. No. 305,307 filed Sept. 24, 1981, now U.S. Pat. No. 4,382,823.

BACKGROUND OF THE INVENTION

Field of the Invention

This invention relates to a process for the purification of unrefined sugar solutions. More specifically, it relates to a process for removing turbidity, color, flavor, and odor from impure sugar solutions which may or may not be subjected to further crystallization.

Soft drink manufacturers virtually always require refined sugar for use in their beverages. However, many countries do not have sufficient refining capacity, and in these countries only mill sugar may be available to certain industries. Before using mill sugar for soft drinks it is necessary to remove from it the turbidity, color, flavor, and odor. The sugar syrups (or simple syrups) are generally made at about 60° Brix.

The *Cane Sugar Handbook,* Meade and Chen, Tenth Edition, John Wiley and Sons, (New York, 1977) page 129, and references therein, each of which references is herein incorporated by reference, discloses in the manufacture of raw sugar (mill sugar), the dark colored raw cane juice, containing gums, waxes, proteins, organic acid, minerals, and particles of vegetable material, is first treated by adding lime to the hot juice. The lime reacts with the organic acids in the juice and forms an insoluble floc with various colloids and with the phosphates in the juice. The floc, containing impurities, is usually allowed to settle to the bottom of the reaction vessel. Alternatively, the floc may be removed by flotation. Polyelectrolytes are usually added to increase the size of the floc particles, and this "secondary" floc is then conventionally allowed to segregate or caused to rise by aeration, employing nozzle injection systems, high speed pumping or agitation. The floc-flotation-clarified cane juice is then evaporated in a multi-effect vacuum evaporator and crystallized in a vacuum pan.

The mixture of sugar crystals and sugar syrup or massecuite, is subsequently centrifuged to remove most of the dark mother liquor, or molasses, from the crystals. Residual molasses remaining on the crystals may then be removed with a water spray during continuing centrifugation. The greater the volume of wash water used to wash the crystals, the purer the resulting mill sugar will be. On the other hand, the more water used, the more the sugar crystals will dissolve, thus reducing the yield of mill sugar. However, no matter how thoroughly the crystals are washed, they may contain impurities occluded within the crystals. These impurities could be reduced by using more lime and phosphoric acid in the flocculation step, but again, at the expense of yield. Thus, even the best raw sugars (mill sugars) may contain various impurities.

Whereas, mill sugar is suitable in the preparation of products such as candy, bakery products, and sweeteners for coffee or tea, said sugar is undesirable in the production of soft drinks because the color, aroma, flavor, and turbidity of the sugar may affect the character of the soft drinks and shorten their shelf life.

Many sugar mills produce "sulfitated" sugars, wherein the cane juice is treated with sulfur dioxide prior to evaporation. These sugars often have a white appearance, which makes them suitable for certain uses, even though the aroma, flavor, and turbidity may not have been significantly reduced by this treatment. Mill sugar made with other special processing steps, such as extra washing, is called "mill white" or "plantation white," and is also suitable for certain uses. Generally, however, neither sulfitated sugar nor plantation white sugars are pure enough for use in soft drinks, in which higher quality refined sugars are necessary.

In manufacturing refined sugar, crystalline raw sugar, containing a number of undesirable non-sugar constituents, is first washed with water to remove any adhering syrup. The syrup that is washed off the crystals is similar in nature to raw cane juice and is treated separately to recover the sugar from it. The washed sugar is dissolved in water, and the resulting syrup is then clarified by floc-flotation after aerating by conventional means. The clarified syrup is then decolorized with activated carbon, bone char or other appropriate decolorizing substances to give a purified "fine liquor." The fine liquor is then crystallized to yield refined sugar. The degree of refinement depends on the number, and the effectiveness, of the flocculation and decolorization steps.

The flocculation steps using conventional techniques may comprise addition of lime and a phosphate ion source, such as phosphoric acid, to the liquor to form a calcium phosphate floc. The floc is conventionally removed by air flotation. A polyelectrolyte may be added in order to form a secondary floc, thereby increasing the size of the floc particles. Decolorization of the clarified liquor is usually accomplished by passing it through columns of bone char before the final crystallization.

The floc clarification process consists of adding to the dissolved sugar small amounts of lime and phosphoric acid, or lime and soluble phosphate salts or aluminum sulfate. At about neutral pH, the lime and phosphate or aluminum sulfate form an insoluble, primary floc wherein, said floc is calcium phosphate or aluminum hydroxide floc which contains insoluble matter, some of the colloids, and much of the color. The floc cannot be conveniently filtered because of its gelatinous nature. It will settle if given enough time, but it does not compact well enough to obtain a satisfactory yield of clarified syrup. Centrifuging in a continuous centrifuge is not satisfactory either, especially at high sugar concentrations (50° to 60° Brix), probably because the turbulence in the centrifuge breaks the floc particles into smaller particles of a density about the same as or less than the syrup, so that a significant amount of floc is left in the syrup after centrifugation.

Another method for removing the primary calcium phosphate or aluminum hydroxide floc from sugar syrups by flotation with air. Generally, a polyelectrolyte is added to form a secondary floc to which gases will more easily adhere, thus making the flotation more efficient.

For flotation to occur, there must be enough bubbles which either adhere to or are captured by the secondary floc and rise to the surface of the syrup where a scum mat forms. The clarified sugar underneath is passed through a polishing filter and is then ready for use. The scum remaining in the tank contains sugar in an amount sufficient such that recovery of the scum is desirable. The recovery consists of mixing the scum with an appropriate amount of water, said amount of water being equal to or less than all the water required for the next batch. The resultant mixture is then aerated, more polyelectrolyte added, and flotation allowed to take place. A scum mat then forms on the surface. The clarified, dilute sugar solution is removed and may be employed in a new batch of higher Brix syrup. The scum containing some sugar may be discarded or recovered by a further recovery step or steps.

Mechanically generated air bubbles are commonly used in commercial floc flotation in sugar syrups, although carbon dioxide or oxygen bubbles are suitable for flotation of chemical flocs.

DISCUSSION OF PRIOR ART

U.S. Pat. No. 3,116,442 to Duke relates to the clarification of sugar liquor defecated with phosphoric acid and lime by mixing a small quantity of an organic amine, preferably a salt of a higher fatty amine, into the defecated liquor, incorporating a multiplicity of finely divided gas bubbles into the liquor containing amine at elevated temperature, maintaining the gas filled liquor quiescent at elevated temperature, and withdrawing from the top of the liquor a dark scum which is a concentrate of defecating agent with enmeshed impurities originally in the defecated liquor as well as color bodies originally in the defecated liquor, leaving a clarified and decolorized sugar liquor as a residue. U.S. Pat. No. 3,116,442 further discloses at Column 3, lines 27 to 30 use of carbon dioxide as the impregnating gas.

U.S. Pat. No. 3,479,221 to Buhl relates to a sugar purification process, wherein an aqueous sugar slurry containing sugar and impurities (either from cane or beet) is contacted with an acrylamide-beta methacrylyloxyethyltrimethylammonium methyl sulfate copolymer as an aid in flocculating and settling suspended solids. The use of said copolymer in the clarification step results in the copolymer flocculating the sugar impurities into large dense flocs which increases the settling rate of the impurities and the amount thereof settled.

U.S. Pat. No. 3,539,393 to Silva, et al. relates to a sugar clarification process comprising two-step heating with chemicals in which the sugar solution is initially treated with alum and pH stabilized with lime prior to the first heating and activated silica is added either before or after the second heating after which the solution is softened or deionized to remove scale forming minerals and/or other dissolved ions.

U.S. Pat. No. 3,853,616 to Rundell, et al. relates to a process for separating suspended solids from an aqueous sugar-containing liquor, which comprises forming a primary floc in the liquor containing suspended solids by phosphatation, preferably after treatment with a cationic surfactant, aerating the liquor containing the primary floc with agitation, distributing an organic polymeric flocculant uniformly throughout the liquid phase of the aerated liquor, to initiate the formation of a secondary floc therein, retaining the resultant mixture in a flocculator vessel with non-turbulent agitation preventing the segregation of the secondary floc to grow, transferring the liquor with minimal agitation, from the flocculator vessel to a separator vessel, allowing the secondary floc to segregate by flotation from the liquor in the separator vessel, and separately removing clarified liquor and flocculated solids from the separator vessel.

U.S. Pat. No. 3,926,662 to Rundell, et al. relates to a process for removing suspended solid impurities from sugar cane evaporated juice or sugar cane affination syrup, comprising adding a soluble phosphate sale to said sugar to form therein an insoluble calcium phosphate primary floc containing said suspended impurities, aerating the liquor containing the primary floc, with agitation, distributing uniformly throughout the aerated liquor from 1–40 parts by weight of an anionic flocculating agent per million parts by weight of sugar in the liquor to initiate the formation of a secondary floc therein, said flocculating agent being a polymer with a molecular weight from 1,000,000 to 10,000,000 containing 50 to 80 mol percent acrylamide units and from 50 to 20 mol percent of anionic units, retaining the resulting mixture for from 15 seconds to 5 minutes in a flocculator vessel with non-turbulent agitation preventing the segregation of the secondary floc from the liquor and allowing the secondary floc to grow, transferring the liquor containing the secondary floc with minimal agitation and shear from the flocculator vessel to a separator vessel, allowing the secondary floc to segregate by flotation from the liquor in the separator vessel, and separately removing clarified liquor and flocculated solids from the separator vessel.

U.S. Pat. No. 4,076,552 to Farag, et al. discloses a process for decolorizing sugar solutions with peroxide, which includes the steps of adding lime to the juice, adding peroxide, contacting the juice with carbon dioxide, filtering the juice, treating the juice with $SO_2$, concentrating the juice and crystallizing sugar solids from the juice.

U.S. Pat. No. 4,196,017 to Melville, et al. relates to a method for reducing color impurities in sugar-containing syrups, comprising adding hydrogen peroxide to the syrup and mixing it with the syrup, adding a suitable cationic surfactant, and mixing, thereafter adding a suitable defectant, such as a mixture of calcium chloride and sodium carbonate, followed by adding and mixing activated vegetable carbon and diatomaceous earth, then filtering out the solids to obtain a purified sugar solution.

U.S. Pat. No. 3,909,287 to Rundell, et al. relates to a process for the recovery of sugar from clarifier scum by countercurrent extraction, wherein sugar is recovered from the clarifier scum by a multi-stage reflotation process involving at least two consecutive stages of counter-current aqueous extraction, using an organic polymeric flocculating agent.

A publication entitled "TALO Technology—a summary of processes, products and equipment from Tate & Lyle Engineering Ltd." discloses a process for scum desweetening which generally involves two or three consecutive stages of counter-current extraction with the desweetening water, wherein each extraction stage comprises the steps of:

(1) Dispersing the scum in desweetening water to give a homogeneous mixture and simultaneously aerating the mixture.
(2) Adding a solution of TALOFLOTE flocculant and dispersing this uniformly throughout the aerated mixture, to produce stable flocs which contain both scum particles and air bubbles.
(3) Passing the mixture from step 2. without any further agitation or shear into a special clarifier.
(4) Allowing the flocculated scum to separate from the mixture by flotation in the clarifier.
(5) Separately removing the clarifier sweetwater and flocculated scum from the clarifier.

U.S. Pat. No. 4,288,551 to Gudnason, et al. relates to a process for removing color, turbidity, flavor, and odor from impure sugar syrups by entrapping the sugar impurities in an insoluble, primary calcium phosphate or aluminum hydroxide floc at about neutral pH, adding a suitable amount of hydrogen peroxide with catalase to form a quantity of oxygen bubbles, and, during bubble formation, adding a polyelectrolyte to convert the primary floc into a secondary floc in which the oxygen bubbles are entrapped thereby causing flotation. The purified sugar syrup is then filtered with or without activated carbon and small amounts of a filter aid to produce a sugar syrup with substantially reduced color, turbidity, flavor, and odor.

SUMMARY OF THE INVENTION

It is an object of the present invention to provide a process for the purification of an impure sugar syrup of about 40° to 65° Brix. Preferred is the use of an impure sugar syrup of 50° to 65° Brix. Especially preferred is the use of a 60° Brix impure sugar syrup.

Another object of this invention is to provide a process for the purification of an impure sugar syrup of about 40° to 65° Brix which does not require specialized apparata.

A further object of this invention is to provide a process which substantially reduces the amount of time and energy required to aerate a batch of impure sugar syrup.

Another object of the present invention is to provide a process, wherein flotation occurs almost immediately after the addition of the aerated portion of sugar syrup and the polyelectrolyte solution.

Yet another object of the invention is to provide a process, wherein the impure sugar syrup may be aerated in such a manner whereby break-up of floc particles is substantially avoided. Furthermore, breakdown of carbon particles is substantially eliminated.

These and other objects are achieved by a process for the purification of an impure sugar syrup of about 40° to 65° Brix, which substantially eliminates the problems encountered in the prior art of successfully generating enough suitably sized air bubbles to achieve good floc flotation.

In accordance with the present invention, it has now been discovered in a process for the purification of an impure sugar syrup of about 40° to 65° Brix, the improvement comprising:

(a) maintaining said syrup at a temperature not greater than about 90° C. and not less than a temperature at which formation of a primary floc may proceed to substantial completion;

(b) combining said syrup with lime and either a phosphate ion source of aluminum sulfate, said lime or said phosphate ion source or said lime and said aluminum sulfate provided respectively in amounts sufficient to form an amount of a primary calcium phosphate floc or aluminum hydroxide floc, respectively, sufficient to capture a substantial amount of the impurities present in said syrup, wherein said lime is added in an amount sufficient to raise the pH of said syrup to a pH of about 6 to 8;

(c) dividing said syrup into a large portion and a small portion, said small portion containing between 5% and 15% of the volume of the impure sugar syrup;

(d) diluting said small portion of said syrup with water in an amount sufficient to adjust the Brix of said syrup to about 35° to 45° Brix;

(e) aerating said Brix syrup by circulating said syrup at least once in a homo mixer, high-speed blender, a centrifugal pump equipped with an air inlet or a high-impeller-speed, or a positive displacement pump equipped with an air inlet;

(f) recombining said aerated small portion with said large portion and agitating for a time sufficient to obtain a uniformly aerated syrup;

(g) dispersing throughout said recombined impure sugar syrup an amount of 0.05 to 0.3% polyacrylamide polyelectrolyte solution sufficient to form an agglomerated secondary floc having entrapped therein sufficient quantities of air bubbles to cause flotation, said dispersing being done after a time interval following said recombining and being accomplished using substantially non-turbulent agitation such that said secondary floc will not be broken up and will allow a sufficient amount of said bubbles to be retained by said secondary floc to cause flotation;

(h) discontinuing said non-turbulent agitation not more than about 180 seconds following the commencement of said dispersing;

(i) allowing the flotation of said secondary floc containing impurities and a portion of the sugar from said syrup, thereby forming a scum and leaving a substantially purified sugar syrup; and (j) separating said purified sugar syrup from said scum.

The invention provides greatly improved economics and convenience for purifying sugar syrups by adding to the syrups suitable amounts of floc-forming chemicals such as lime and phosphoric acid or lime and aluminum sulfate to form a primary floc which traps color and other impurities of the sugar, adding carbon if desired, removing 5 to 15%, preferably a 5 to 10% portion, of the floc-containing syrup (or, if desired, removing the portion before the addition of chemicals), adjusting its Brix to about 35° to 45° Brix, preferably 40° Brix, saturating the small portion with air by means of common aeration devices such as a centrifugal pump equipped with an air inlet, a homo mixer, high-speed blender, or a high impeller speed positive displacement pump, mixing the dilute, aerated small portion with the bulk of the syrup, mixing with the aerated syrup an appropriate amount of a polyelectrolyte solution to form a secondary floc, stopping the agitation, and allowing the secondary floc to rise to the surface to form a scum mat.

In accordance with the present invention, the process may further comprise the step of recovering sugar entrapped in said scum, said sugar recovered in the form of a dilute syrup for use in preparing said impure sugar syrup.

Specifically, the present invention may further comprise the steps of:

(k) recovering sugar from the scum by agitating said scum for a time sufficient to obtain a uniformly blended syrup, said sugar being agitated with an amount of water substantially equivalent to that employed in step (a);

(l) ceasing agitation and allowing the flotation of the exhausted secondary floc to form a scum;

(m) separating the dilute sugar syrups from said scum; and (n) producing a second batch of 40° to 65° Brix syrup by adding appropriate amounts of impure sugar to said dilute sugar.

Impure sugar syrups vary in the ease at which they may be aerated. The presence of the added chemical floc, and carbon when used, may reduce the efficiency of aeration. An advantage of the present invention is that the sugar syrup can be aerated without floc or carbon to get the most efficient aeration. This is not possible if the syrup is aerated as one batch. The separate aeration also avoids break-up of floc particles and production of micropulverized carbon.

An important additional advantage is that in the step to recover sugar from the scum mat, no further aeration nor addition of polyelectrolyte is necessary, thus making the recovery step much easier than when having to reaerate the scum mixture and add more polyacrylamide, as described in the prior art literature. Perhaps this is because the bubbles formed with the present method are extremely small, and not as easily lost from the scum as larger bubbles.

DETAILED DESCRIPTION OF THE INVENTION

A complete understanding of the invention, including the best mode of operation thereof, will be gained by those skilled in the art from the following discussion taken in conjunction with the following examples.

DISCUSSION OF THE INVENTION

In accordance with the invention, a small portion of the 40° to 65° Brix syrup, about 5% to 15% based on the total impure sugar syrup, preferably 5% to 10%, is removed. The Brix of said small portion is adjusted to 35° to 45° Brix, preferably about 40° Brix, by diluting said portion with water.

The 40° to 65° Brix syrup contains floc-forming chemicals, such as lime and phosphoric acid or lime and aluminum sulfate, which form insoluble calcium phosphate or aluminum hydroxide floc. Carbon may be optionally added. The small portion may be removed prior to or after addition of floc-forming chemicals.

The 35° to 45° Brix syrup portion is easily aerated using various types of common apparatus. The apparatus may consist of a positive displacement pump with high impeller speed, or a centrifugal pump, in either case equipped with an air inlet, alternatively, a homo mixer or a high speed blender may be used. Preferred is use of a positive displacement pump equipped with high impeller speed or a centrifugal pump.

The 35° to 45° Brix syrup is sufficiently aerated by circulating it once. If the pump has a capacity of 2.5 liters per minute it will take one minute to aerate 2.5 liters of the 35° to 45° Brix syrup, which is sufficient to aerate about 25 liters of 40° to 65° Brix syrup. If the same equipment is used to aerate 25 liters of 40° to 65° Brix syrup as one batch, a flotation will take place after recirculating it for about 10 minutes and mixing in with it an appropriate amount of polyacrylamide and stopping agitation, but the scum will be thicker than the scum found in the 60° Brix syrup aerated by adding it to the recirculated 10% volume of 40° Brix syrup. Thus, even after expending much more energy and time by aerating a total batch of 60° Brix syrup, the invention offers the advantage of a smaller scum volume, and thus smaller sugar losses. It should be noted here than the syrup must be made at higher than 60° Brix if a final Brix of 40° to 65° is desired, because of the dilution with some 35° to 45° Brix syrup. The water used for the dilution should preferably be cold, since the air bubbles are more stable at low temperatures than at high temperatures.

It may be observed when aerating the syrups that most of the bubbles incorporated at 40° to 65° Brix are relatively large, and it takes much recirculation until the syrup turns creamy in appearance. Most of the large bubbles escape to the surface of the syrup almost immediately. At about 35° to 45° Brix, however, the syrup turns creamy almost at once with very fine air bubbles. It is also noticeable that the exact adjustment of the air inlet is very difficult in the 60° Brix syrup, but in the 40° Brix syrup the adjustment is not very critical. The air bubbles in the 35° to 45° Brix portion may disappear if the portion is not added to the 40° to 65° Brix syrup within a reasonable time. Flotation will not occur, but once they are incorporated in the 60° Brix syrup, these fine bubbles are very stable and will cause flotation to take place upon the addition of polyelectrolyte when agitation has been ceased.

If aeration of the entire 40° to 65° Brix batch is desired, the floc chemicals and optionally carbon, are added before aeration, and the floc is formed. The floc does not form immediately but requires a few minutes for the reaction to complete and aggregation of the floc particles to take place. During the aeration, the floc in the syrup is subjected to fairly turbulent action, and this breaks up the floc so that after aeration, a few minutes are needed for the floc to reform itself, before adding polyacrylamide and stopping agitation. During these minutes some of the air in the syrup tends to escape, thus leaving less air for the flocation.

In the present method none of the floc or only a portion of the floc is subjected to turbulent agitation, and as soon as the aerated portion is added to the larger portion, the polyacrylamide may be added and flotation allowed to begin.

When some activated carbons are subjected to highly turbulent pumping or agitation, they break up into micro-sized particles. If this happens, the carbon may pass through the filtration equipment and thus remain in the syrup and the final product. Such agitation is avoided with the present invention since only a portion of the carbon, in the range of 0% to 6%, is subjected to such violent action.

When lime and phosphoric acid are used as the floc chemicals, it is necessary to heat the syrup to at least 70° C. in order for the insoluble, calcium phosphate floc to form. In accordance with the preferred procedure, the flotation is then allowed to take place at 70° C. to 90° C. It may be observed that the higher the syrup temperature, the quicker the floc will rise after aeration. Polyacrylamide is subsequently added and agitation is discontinued.

When lime and aluminum sulfate are employed, an aluminum hydroxide floc may form at room temperature, or even lower, or at temperatures above room temperature. It has been found that the aluminum hydroxide floc can be removed from the syrup by flotation at temperatures as low as 20° C. However, the floc then rises relatively slowly, and the scum will take much longer to compact. If the temperature of the syrup is raised, the flotation will be completed more quickly. The preferred range is 20° C. to 90° C. Especially preferred is 30° to 90° C.

The choice of the floc-forming chemicals used depends on, for example, whether or not heating and cooling facilities are available. If heating and cooling are available, the lime and phosphoric acid (or phosphates which form a floc with lime) may be used. An advantage of using calcium phosphate floc is that the small portion to be aerated may include the calcium phosphate floc. This improves the aeration. Lime-aluminum sulfate may be used where little or no heating or cooling of the syrup is possible. An advantage of using aluminum hydroxide floc is that more color is removed from the syrup compared with the results achieved when calcium phosphate floc is employed. However, by the preferred procedure of the invention the aluminum hydroxide should not be present in the portion to be aerated since the floc reduces the stability of the air bubbles.

The amount of floc chemicals that may be added depends on the degree of sugar purification needed and the amount of sugar loss which is acceptable. It appears that as more lime is added (and neutralized with aluminum sulfate, phosphoric acid, and the like), the greater the amount of scum formed under given conditions. In accordance with the present invention it is preferred to add 0.025% to 0.2% lime by weight of the sugar present in the syrup. For example, if the lime added is 0.025% by weight of the sugar in the syrup, the scum weight may be about 2.5% of the total weight of the syrup and will contain about 2.5% of the sugar. After a second flotation for sugar recovery using all the amount of water needed for a next batch for dilution of the scum, the amount of sugar discarded in the second scum will be about 0.25%. Conversely, if the lime added is 0.1% of the weight of the sugar, the scum will contain 5% to 10% of the total sugar, and the scum left after sugar recovery will contain 0.5% to 1% of the total sugar. Of course, if it is necessary to use a large amount of lime, as when the sugar is very highly colored and dirty, a secondary recovery step might be included in the process.

It should be mentioned, in connection with the floc-forming materials, that the pH of the sugar may vary, and it is important that the materials be added in such a ratio that the pH of the syrup falls between about 6 and 8, preferably about 6 and 7.5. At a pH of 6.5 the effect of the floc is very good. At higher pH's less color is removed and scum volume is increased. At pH's below 6, little or no flotation will occur.

To increase color removal, it is desirable to add carbon to the 40° to 65° Brix syrup. However, it is advisable that carbon be employed in an amount substantially equivalent to the amount of lime added. If the amount of carbon added exceeds an equivalent amount of lime, then the carbon begins to increase the weight of the secondary floc, and the syrup may contain suspended floc.

Preferably, the carbon is not added to the portion to be aerated. It has been observed that carbon decreases the stability of the air in the small portion. However, the carbon may be added where the characteristics of the sugar itself are such that the air in the small portion of the syrup has been shown to be sufficient when said small portion is recombined with the large portion to cause flotation in the larger portion.

Once the aerated 35° to 45° Brix portion has been adequately mixed into the main batch, the polyacrylamide solution is added as a 0.05 to 0.3%, preferably 0.05 to 0.15%, and especially a 0.1% aqueous solution. For example, when a 0.1% polyacrylamide solution is added, the syrup contains about 1.5% by weight polyacrylamide based on the amount of pure lime in the syrup. In accordance with the invention the amount of polyacrylamide dispersed is 1.4% to 1.6% by weight of the lime added to the sugar. When the amount of pure lime is 0.05% by weight of sugar in a 60° Brix syrup, the polyacrylamide concentration is about 7.5 parts per million by weight of the total amount of sugar. The exact amount of polyacrylamide added may depend on which type is used. It is very important that only the amount necessary to improve the flotation be used. If too much polyacrylamide is added, some of the polyacrylamide may remain in the sugar, and that is undesirable. Any of the polyacrylamides in general used in sugar purification, such as American Cyanamid's Magnifloc 846A® or Dow Chemical's Separan AP30®, may be used. Preferred is use of a polyacrylamide electrolyte selected from the group consisting of anionic polyelectrolytes.

The length of time it takes to mix the polyacrylamide properly in the syrup depends on the type and speed of agitation in the syrup tank and the concentration of the polyacrylamide solution. Generally about one minute is needed to mix the polyacrylamide completely when it is added as a 0.1% solution. Agitation is then stopped, and the secondary floc begins to form and rise to the surface of the syrup.

The polyacrylamide may be mixed with the syrup before the aeration portion is added. The flotation is not affected by this reversal, but there is no advantage to doing this.

Almost immediately or at least within a few minutes, while the secondary floc is still rising, the clarified syrup may be gradually removed through the bottom of the sugar purification vessel. The scum volume will be reduced to a minimum in about 20 minutes in a hot syrup (longer if the syrup is cool). In a large syrup tank the scum volume minimum is reached long before all the clarified syrup has been removed. The clarified syrup is passed through a filter press containing a precoat of filter aid for polishing and carbon for added color removal, if desired.

When all of the clarified syrup has been removed from the tank or vessel, the pump is stopped and the bottom valve of the tank closed. To recover the sugar from the scum, it is now only necessary to add into the tank all the water needed for the next batch, mix it with the scum for 1 to 2 minutes, stop the agitation, and let the now-extracted scum rise again. The volume of this second scum will be slightly less than that of the first scum, and the sugar loss is about 2.5% to 10% of the sugar retained in the first scum or 0.25% to 1% of the total sugar. No further aeration is needed for the flotation of the second scum, and no more polyelectrolyte is necessary.

The dilute sugar syrup, containing all of the water for the next batch to be purified and some of the sugar, is now pumped into another syrup tank and enough impure sugar dissolved in it to make another batch. The scum from the first tank may be discarded, the tank rinsed, and the process repeated with the subsequent batch.

The success of a flotation of floc may be measured by three criteria:

(1) The speed at which the floc rises.

(2) The compactness of the scum after a given time.

(3) The clarity of the syrup under the scum.

The effect of the floc flotation on the quality of the sugar depends on the amount of floc and the kind of floc chemicals used.

SPECIFIC EMBODIMENTS

EXAMPLES 1 TO 14

In the following examples the chemicals used were as follows: calcium hydroxide ($CA(OH_2)$) was from J. T. Baker Chemicals (reagent grade); aluminum sulfate ($Al_2(SO_3)_3+18H_2O$) was from Fisher Scientific Company (technical grade); the polyelectrolytes (polyacrylamides) were either American Cyanamid's Magnifloc 846A ® or Dow Chemical's Separan AP30 ®.

The impure sugar syrups were produced by dissolving in water a mixture of refined sugar (obtained from the Georgia Refining Company, Matthews, La.) and raw sugar (from the Savannah Sugar Refinery, Savannah, Ga.). The mixture consisted of one part raw sugar and 19 parts of refined sugar, and was of a quality similar to that of an average centrifugal sugar.

EXAMPLE 1

An experiment was performed which compared the relationship between energy required to aerate an entire batch of 60° Brix sugar syrup and the energy needed to aerate using the process of the invention.

To seven liters of a 60° Brix impure sugar syrup were added 0.05% of lime (as 100% pure CaO) and 0.15% of aluminum sulfate ($Al_2(SO_4)_3+18H_2O$). The pH of this preparation was 6.5 and the temperature about 45° C. This primary floc containing syrup was then divided into two equal portions.

PART A

A 3.5 liter portion was aerated in a homo mixer (Gifford-Wood, Hudson, N.Y., coded 2001B) for five minutes. Immediately after the aeration, 7.5 ppm of Separan AP30 ® polyacrylamide (based on weight of lime) in the syrup were added as 0.1% aqueous solution and mixed by agitation for one minute. Agitation was then ceased and flotation allowed to begin.

PART B

From the remaining 3.5 liter of 60° Brix syrup, 210 mls were removed and 140 ml of water added to it. A 350 ml (10%) batch of the resulting 40° Brix syrup (10%) was then aerated in the same homo mixer described in Part A for 30 seconds. The aerated 40° Brix syrup was recombined with 3.290 liters of 60° Brix syrup and mixed well, after which 1.5% of Separan AP30 ® polyacrylamide (based on weight of the lime added to the batch) was added to the syrup as a 0,1% aqueous solution and mixed by agitation for 1 minute. Agitation was then stopped and flotation allowed to begin.

It was observed during the next 20 minutes that in the batch aerated in Part A, the secondary floc rose to the surface slower than in the batch aerated in Part B. More importantly, after the 20 minutes, the scum in batch A was thicker than that in batch B. After standing for 16 hours to insure that in both batches the scum had more than enough time to compact, the volumes of the scum were measured. In batch A of the scum, volume was 11.0% but in batch B it was 7.1%.

The results of this experiment showed that even 10 times more aeration time of the 60° Brix syrup produced a flotation which was less satisfactory than the flotation caused by adding the aerated 10%, 40° Brix portion to a 60° Brix syrup.

EXAMPLE 2

To determine what would be the preferred Brix for aerating the small portion, the following experiments were conducted.

Six portions of a 60° Brix syrup containing 0.1% lime and neutralized with phosphoric acid to a pH of 6.3 were adjusted in Brix to 50°, 45°, 35°, and 30° Brix; one portion remained at 60° Brix. An equal size sample of each one of these portions was aerated in a positive displacement pump (Flotec, Inc., Norwalk, Calif., Model R251-114V) with a high impeller speed, and equipped with an air inlet, for exactly 60 seconds. The portions were added to batches of 60° Brix syrups at 70° C. at a level of 10% of each of the small portions. After thoroughly mixing in the aerated portions, 1.5% (based on weight of lime) of polyacrylamide Magnifloc 846A ® was added to each of these as a 0.1% solution and mixed for 60 seconds.

The aeration characteristics of the small portions were observed and the characteristics of the flotation recorded, including scum volumes after 20 minutes.

The results of the experiment are summarized in TABLE I.

TABLE I

DETERMINATION OF PREFERRED RANGE OF ° BRIX FOR AERATED PORTION OF SUGAR SYRUP

| 10% Aerated Portion | | | Flotation | | |
|---|---|---|---|---|---|
| Brix | Creaminess | Stability | Speed | Syrup Clarity | Scum Volume |
| 60 | very slight | very stable | very slow | turbid | 24.0% |
| 50 | yes | very stable | slow | turbid | 14.3% |
| 45 | yes | very stable | fast | clear | 12.9% |
| 40 | yes | stable | fast | clear | 10.3% |
| 35 | yes | unstable | fast | clear | 10.8% |
| 30 | yes | unstable | fast | clear | 11.6% |

These data show that about 40° Brix is the optimum Brix to obtain the aeration. Above 40° Brix the air incorporation is enough to cause a good flotation (except with the 60° Brix sample), but with higher scum volumes, indicating not quite enough air to compact the scum to a minimum. At lower than 40° Brix the aeration is very good, but some of the air is lost when the respective small portions are recombined with their corresponding larger portions, thus resulting in not having quite enough air to compact the scum to its minimum volume.

EXAMPLE 3

To show the effect of the size of the 40° Brix portion on the flotation relative to the main batch of sugar syrup, 60° Brix syrups were aerated by adding to them 5, 10, and 15% of their volume after aerating each of these fractions for 1 minute each. The aeration was done by pumping the 40° Brix portion through a positive displacement pump (Flotec, Inc., Norwalk, Calif., Model 110 4V) with a high speed impeller and equipped with an air inlet, and having 4-liters-per-minute capacity. The aeration was excellent. Flotation took place after 1.5% of polyacrylamide Magnifloc 846A ® (based on the amount of lime) was thoroughly mixed with the syrup. Agitation was ceased.

The 60° Brix syrup contained 0.075% lime and enough phosphoric acid to bring the pH of the syrup to 6.5. The following observations were made on the flotation in the 70° C. syrup. Scum volume was measured after 20 minutes. Results of this experiment appears in TABLE II.

TABLE II

RELATIONSHIP OF FLOTATION AND PROPORTIONATE SIZE OF 40° BRIX PORTION

| Forty Brix Portion Relative to Main Portion | Flotation Speed | Syrup Clarity | Scum Volume |
|---|---|---|---|
| 5% | slow | clear | 9.4 |
| 10% | fast | clear | 7.5 |
| 15% | fast | clear | 7.5 |

The experimental results in Table II reveal that if the aeration is excellent, 10% of the 40° Brix syrup is sufficient to aerate the 60° Brix syrup.

EXAMPLE 4

To show that aeration of the 40° Brix can be accomplished with a centrifugal pump, equipped with an air inlet, the following experiment was performed.

To 110 liters of a 60° Brix impure sugar syrup at 70° C. were added 0.1% lime and an equivalent amount of phosphoric acid to form a floc at a pH of 6.5.

A 10-liter portion of the 60° Brix syrup was removed and aerated with a Tri-Clover® centrifugal pump equipped with an air inlet having 100 liters per minute capacity. The 60° Brix syrup was circulated through the pump for 10 minutes. The syrup did not turn creamy but had numerous large bubbles.

Then four liters of water were added to a six-liter portion, resulting in 10 liters of a 40° Brix syrup. This syrup was aerated by the same pump for 1 minute. The syrup turned very creamy in appearance. It was recombined with the 60° Brix syrup. Polyacrylamide (Magnifloc 846A®) was added (1.5 ppm based on weight of the lime) at a 0.05% solution and mixed for 1 minute.

The agitation was then stopped and flotation allowed to begin. After 20 minutes had elapsed, it was observed that the syrup was very clear, and scum thickness was 10% of the total volume. The results of this experiment revealed that a very successful flotation occurred.

EXAMPLE 5

This experiment was designed to show the effect of temperature and the presence of floc chemicals on the aeration of 40° Brix sugar syrups.

Four 2.5 liter batches of 40° Brix syrup were prepared from impure sugar. Two portions contained 0.05% lime (based on weight of sugar) neutralized with phosphoric acid to a pH of 6.3. No floc chemicals were added to the remaining two portions. Samples containing and not containing floc chemicals were aerated for 2 minutes in a Waring® blender at 25° C. and at 75° C. After the aeration, creaminess of the syrup and the time taken for most of the air to disappear from the syrup (its stability) were recorded. The results of the experiment are summarized in Table III.

TABLE III

EFFECT OF TEMPERATURE AND FLOC CHEMICALS ON AERATION OF 40° BRIX SUGAR SYRUP

| Temperature of 40° Brix Portion | Presence of Floc | Creaminess | Stability |
|---|---|---|---|
| 25° C. | Without floc | Good | 180 secs. |
| | With floc | Fair | 120 secs. |
| 75° C. | Without floc | Poor | 81 secs. |
| | With floc | Poor | 42 secs. |

The data appearing in TABLE III show that the air is more stable in syrups at 25° C. than at 75° C., and that the air stability is greater if the sample does not contain chemicals. Thus, it appears that the lower the temperature of the portion to be aerated, the more is the likelihood of a good flotation. It also appears that the presence of floc chemicals reduces the stability of the air in the 40° Brix syrup regardless of the temperature.

EXAMPLE 6

To determine the effect of syrup temperature on final scum volume, three 3-liter batches of 60° Brix syrup were prepared. After removing 6% portions of these batches, 0.05% lime (based on weight of sugar) was added and then the syrup was neutralized with aluminum sulfate to a pH of 6.3. The 6% portions removed from the batches, which did not contain floc chemicals were diluted to 40° Brix and aerated for one minute in a Waring® blender at 25° C. These portions were added to the batches of 60° Brix syrups at 25° C., 40° C., and 75° C., respectively. After thoroughly mixing in the aerated portions, 1.5% of polyacrylamide-Magnifloc 846A® (based on weight of lime) were added to each of these as an 0.1% aqueous solution and mixed for 60 seconds.

The time needed to reach minimum scum volume was determined by measuring the scum thickness every 5 minutes until no further reduction of the volume of the scum was observed.

The results are shown in TABLE IV.

TABLE IV

EFFECT OF SYRUP TEMPERATURE ON FINAL SCUM VOLUME

| Main Batch Temp. | 0 | 5 | 10 | 15 | 20 | 25 | 30 | 35 | 40 | 45 | 50 | 55 | 60 | Minutes |
|---|---|---|---|---|---|---|---|---|---|---|---|---|---|---|
| 25° C. | 0 | 0 | 3 | 2.9 | 2.8 | 2.0 | 2.0 | 2.0 | 2.0 | 2.0 | 2.0 | 2.0 | 2.0 | Scum Vol. (cm) |
| 40° C. | 0 | 2.3 | 1.9 | 1.7 | 1.5 | 1.5 | 1.5 | 1.5 | 1.5 | 1.5 | 1.4 | 1.4 | 1.4 | Scum Vol. (cm) |
| 75° C. | 0 | 1.4 | 1.3 | 1.3 | 1.3 | 1.3 | 1.2 | 1.2 | 1.2 | 1.1 | 1.1 | 1.1 | 1.1 | Scum Vol. (cm) |

These data show that the minimum scum volume is reached in about 30 minutes regardless of temperature. However, the scum volumes are smaller at higher than at lower temperatures.

EXAMPLE 7

To show how the presence of carbon affects the aeration of a 40° Brix syrup, the following experiment was performed.

Four portions of 40° Brix syrups were used. The first portion contained 0.25% carbon (based on sugar) and no floc chemicals. The second portion contained 0.05% lime neutralized with phosphoric acid to a pH of 6.4, but no carbon. The third portion contained both floc chemicals (0.05% lime and phosphoric acid to a pH of 6.4) and 0.025% carbon based on sugar. The control contained neither carbon nor floc chemicals. The samples were aerated at room temperature in a Waring® blender for 1 minute.

The amount of time taken for most of the air to escape out of the container was recorded, as well as the creaminess of the syrup.

The results are shown in TABLE V.

TABLE V

EFFECT OF CARBON ON THE AERATION OF A 40° BRIX SYRUP

| 40° Brix Syrup | Aeration | |
|---|---|---|
| | Creaminess | Stability |
| No floc, no carbon | Good | 180 secs. |
| No floc, 0.025% carbon | Poor | 66 secs. |
| Floc and no carbon | Fair | 120 secs. |
| Floc and 0.025% carbon | Very Poor | 15 secs. |

The data in TABLE V show that the presence of either floc chemicals or carbon reduce aeration and air stability. However, the addition of floc chemicals and carbon results in a cumulative effect on the reduction of air stability.

EXAMPLE 8

In order to determine how the presence of carbon in the 60° Brix syrup affects the flotation of the scum, two batches of a 60° Brix syrup were prepared. Each batch was divided into 5 portions and these portions contained 0.05% lime neutralized with either phosphoric acid or aluminum sulfate to a pH of 6.3. Varying amounts of carbon were added to the batches containing either phosphoric acid or aluminum sulfate.

Portions of 60° Brix syrup, which did not contain floc chemicals or carbon added, were diluted to 40° Brix aerated in a Waring® blender for 1 minute, and added to the floc-and-carbon-containing batches at a level of 10% of the total batch volumes. Subsequently, 0.5 by weight based on amount of lime (0.1% aqueous solution) of polyacrylamide-Magnifloc 846A® (based on amount of lime) was added to the respective batches. The batch temperatures were 75°.

The characteristics of the flotation were observed. The results of this experiment appear in TABLE VI.

TABLE VI

PRESENCE OF CARBON IN 60° BRIX SYRUP VS. FLOTATION OF SCUM

| Amount of Carbon in 60° Brix Syrup | FLOTATION | | | | | |
|---|---|---|---|---|---|---|
| | Aluminum Sulfate | | | Calcium Phosphate | | |
| | Speed | Syrup Clarity | Scum Vol. (%) | Speed | Syrup Clarity | Scum Vol. (%) |
| None | Very fast | Excellent | 6.1% | Fast | Very good | 9.5% |
| 0.025% | Very fast | Excellent | 7.6% | Medium fast | Good | 11.0% |
| 0.050% | Fast | Very good | 7.1% | Medium slow | Fair | 11.0% |
| 0.075% | Medium slow | Poor | 6.6 | Slow | Poor | 12.3% |
| 0.100% | Medium slow | Very poor | 6.6 | Very slow | Very poor | 0% |

The data appearing in Table VI shows that it is not possible to have a good flotation if the amount of carbon is greater than the amount.

EXAMPLE 9

The experiment described below was conducted to determine how the amount of floc chemicals added to the syrup affects the scum volume and the purification of the sugar.

Five batches of 60° Brix sugar syrups were prepared. A 6% portion by volume of said syrup was removed for use in the aeration. To said remaining batches of 60° Brix syrup was added 0%, 0.025%, 0.075%, and 0.1% lime. Each of the five batches was then divided into two batches; the first batches were neutralized with aluminum sulfate to the same pH. All the batches were maintained at a temperature of 75° C. The 6% portions (containing no floc chemicals) were diluted to 40° Brix with water and aerated in a Waring® blender for one minute. The aerated portions (10% by volume of the total batch) were then mixed into the 60° Brix syrup. To all of these were added 1.5% Magnifloc 846A® polyacrylamide (based on weight of lime) as a 0.1% aqueous solution and mixed thoroughly.

Flotation then took place, and after 20 minutes, the scum volumes were observed for all the samples. The purified syrup under the scum was removed and the absorbencies measured in a strectrophotometer. The measurements were taken at 420 and 720 nm and calculations of Reference Base Units (quality units) made according to the following formula.

$$\text{Reference Base Units (RBU's)} = \frac{A_{420} - 2(A_{720})}{b \times c} \times 1000$$

Where b is cell length in cm and c is sugar concentration in g/ml.

The results of this experiment appear in TABLE VII.

TABLE VII

RELATIONSHIP OF AMOUNT OF FLOC CHEMICALS AND SCUM VOLUME AND PURIFICATION

| Amount of Lime in Syrup Based on Wt. of Sugar | Scum Volume (%) | | Reference Base Units | |
|---|---|---|---|---|
| | $Al(OH)_3$ | $Ca_3(PO_4)_2$ | $Al(OH)_3$ | $Ca_3(PO_4)_2$ |
| None | None | None | 363 | 363 |
| 0.025% | 2.3 | 2.5 | 159 | 206 |
| 0.050% | 2.8 | 3.0 | 117 | 168 |
| 0.075% | 4.4 | 5.1 | 108 | 155 |
| 0.100% | 5.3 | 5.6 | 92 | 145 |

The data in Table VII show that scum volumes increase with the addition of increasing amounts of floc chemicals. (It appears that the more floc chemicals that are added, the greater the purification of the sugar syrup.)

EXAMPLE 10

To show the effect of pH of sugar syrup on floc flotation, a batch of 60° Brix syrup was made with impure sugar and divided into 9 portions. To 8 of these portions were added 0.1% lime (based on weight of sugar) and aluminum sulfate to give pH of 4.0, 5.0, 6.0, 6.5, 7.0, 8.0, and 8.5.

The ninth portion containing no floc chemicals was diluted to 40° Brix and fractions of it aerated in a Waring ® blender for 1 minute. The aerated portions were added to each of the 8 portions at a level of 10% by volume and mixed well. Subsequently, 1.5% Separan AP30 ® polyacrylamide (based on weight of lime) was added as an 0.1% solution and stirred into the aerated sugar syrup until uniformly mixed. The characteristics of the resulting flotation were then recorded. The experimental results are shown in TABLE VIII.

TABLE VIII

EFFECTS OF pH ON FLOC FLOTATION

| pH of 60% Brix Syrup | FLOTATION Speed | Syrup Clarity | % Scum Volume |
|---|---|---|---|
| 4.0 | — | — | No flotation |
| 5.0 | — | — | No flotation |
| 6.0 | Very fast | Excellent | 8.2 |
| 6.5 | Very fast | Good | 8.1 |
| 7.0 | Fast | Good | 6.9 |
| 7.5 | Medium fast | Good | 8.1 |
| 8.0 | Slow | Very poor | 6.9 |
| 8.5 | — | — | No flotation |

Based on the experimental data in Table VIII, it was concluded that the optimum range of pH to effectuate good flotation was about 6 to 7.

EXAMPLE 11

The following experiment was performed to determine whether polyacrylamide may be added either before or after the 40° Brix aerated portion is mixed into the main batch.

Two 3-liter batches of 60° Brix impure sugar syrup were produced and 6% portions removed. To the main portion were added 0.05% lime (based on weight of sugar) and phosphoric acid until a pH of 6.3 was reached. The 6% portions were diluted to 40° Brix and aerated in a Waring ® blender for 1 minute. To one of the 3-liter batches was added 1.5% of Magnifloc 846A ® polyacrylamide (based on weight of lime) as an 0.1% aqueous solution and mixed until uniform. Immediately thereafter, the aerated portion was added and mixed thoroughly. To the other 3-liter batch was added the aerated portion and mixed well, after which the same amount of Magnifloc 846A ®, as in the first batch, was added. The observations made are shown in TABLE IX.

TABLE IX

ADDITION OF POLYACRYLAMIDE BEFORE AND AFTER ADDITION OF 40° BRIX SYRUP

| | FLOTATION Speed | Syrup Clarity | Scum Volume (%) |
|---|---|---|---|
| Polyacrylamide added before aeration | Fast | Medium fast | 10.5% |
| Polyacrylamide added after aeration | Very fast | Very fast | 11.1% |

The data in Table IX shows that the polyacrylamide may be added before or after aeration. However, improved results are achieved if it is added after aeration.

EXAMPLE 12

To show the percentage of sugar loss when the scum from a second flotation is discarded, the following experiment was performed.

A 25-liter batch of 60° Brix syrup containing 19.292 kg of sugar was heated to 70° C. and 0.05% pure lime based on sugar added. The syrup was neutralized to a pH of 6.6 with phosphoric acid and calcium phosphate floc allowed to form.

Six percent of the batch was transferred to another vessel and diluted with water to 40° Brix. This portion (2.5 liters) was then aerated by circulating for 1 minute in a homo mixer (Gifford Wood, Hudson, N.Y., Model 2001E). The aerated portion was transferred to the larger portion, completely mixed, and 7.5 ppm (based on sugar) of Magnifloc 846A ® polyacrylamide added as a 0.1% solution. After 1 minute of mixing, the agitation was stopped and flotation allowed to take place. After twenty minutes the clarified syrup was completely drained from the vessel until only the scum remained. The scum was then also drained and weighed and Brix determined so that the weight of sugar in it could be calculated. This sum was placed back into the vessel and about 13 liters of water added (the amount of water in the original syrup). The water was mixed with the scum for 1 minute by slow agitation. When the agitation was stopped, the scum was formed almost immediately without any additional aeration or polyacrylamide. The dilute syrup was then completely drained from the vessel. The scum was then weighed and its Brix determined to calculate the amount of sugar in it.

The results of this experiment appear in TABLE X.

TABLE X

SUGAR LOSS WHEN SECOND FLOTATION SCUM IS DISCARDED

| | |
|---|---|
| Weight of sugar in starting syrup | 19,292 kg |
| Weight of sugar in first scum | 787.4 g |
| Percentage of sugar in first scum | 4.1% |
| Weight of sugar in second scum | 65.9 g |
| Percentage of initial weight of sugar in second scum | 0.34% |

From the data in Table X is appears that the percentage of sugar loss in the second scum would be based on data from smaller batches.

I claim:

1. A process for purifying sugar syrup, which comprises:

(a) combining an impure sugar syrup of about 50° to about 65° Brix with a flocculating agent selected from lime in combination with a phosphate ion source, or lime in combination with aluminum sulfate, to form a primary floc in the syrup, wherein the amount of agent added forms an amount of primary floc sufficient to remove a substantial quantity of impurities from the syrup and adjusts the pH of the syrup to about 6 to 8, and wherein the syrup is maintained at a temperature of from a temperature sufficient for floc formation up to about 90° C.;

(b) removing an aliquot from the syrup before or after the syrup is combined with the flocculating agent in step (a), the aliquot being from about 5% to about 15% by volume of the syrup;

(c) diluting the aliquot with an amount of water sufficient to adjust the Brix of the aliquot to about 35° to 45° and form a diluted aliquot;

(d) aerating the diluted aliquot to form a super-aerated aliquot, wherein the diluted aliquot is maintained at a temperature of from about 25° C. up to about 90° C.;

(e) dispersing in the syrup by substantially non-turbulent agitation for up to about 180 seconds, an amount of 0.05% to 0.3% aqueous polyacrylamide electrolyte solution;

(f) adding the super-aerated aliquot to the syrup and mixing to form an aerated syrup with a secondary flotation floc;

(g) allowing the secondary floc to float and form a floating scum and a substantially purified sugar syrup; and (h) separating the scum and the purified syrup.

2. A process according to claim 1, which further comprises:

recovering sugar entrapped in the scum, the sugar being in the form of an aqueous syrup for use in preparing an impure sugar syrup.

3. A process according to claim 1, which further comprises:

agitating the separated scum with water to produce a blended syrup; ceasing agitation and allowing formation of a scum and a dilute sugar syrup; separating the scum and dilute syrup; and adding impure sugar solids to the dilute syrup to form an impure syrup for purification according to steps (a)-(h), the amounts of impure sugar and water being adjusted to produce the impure syrup having from about 50° to 65° Brix.

4. A process according to claim 3, which comprises:

agitating the first scum and water for about 1 to 2 minutes.

5. A process according to claim 1, in which step (a) comprises:

maintaining the temperature of the syrup at from about 20° C. to about 90° C. and employing lime and aluminum sulfate as the flocculating agent.

6. A process according to claim 1, in which step (a) comprises:

maintaining the temperature of the syrup at from about 70° C. to about 90° C. and employing lime and a phosphate ion source as the flocculating agent.

7. A process according to claim 6, which comprises:

employing phosphoric acid as the phosphate ion source.

8. A process according to claim 1, which comprises:

in step (b), removing the aliquot from the syrup before the syrup is combined with the flocculating agent, so that the aliquot is free of flocculating agent.

9. A process according to claim 1, which comprises:

in step (b), removing the aliquot from the syrup after the syrup is combined with the flocculating agent, so that the aliquot contains flocculating agent.

10. A process according to claim 8 or 9, which comprises:

in step (d), maintaining the diluted aliquot at a temperature at about 25° C. and aerating it until it has a creamy appearance.

11. A process according to claim 1, which comprises:

adding as part of the flocculating agent of step (a), lime at about 0.025% to 0.2% by weight relative to the weight of sugar present in the syrup.

12. A process according to claim 1, wherein in step (a), the pH of the syrup is adjusted to about 6.0 to 7.5.

13. A process according to claim 1, which further comprises:

in step (a), adding to the syrup, decolorizing carbon in an amount up to the amount of lime added.

14. A process according to claim 1, wherein the aliquot of step (b) is from about 5% to about 10% by volume of the syrup.

15. A process according to claim 1, which comprises:

in step (f), mixing the super-aerated aliquot and the syrup for about 1 to 5 minutes.

16. A process according to claim 1, wherein in step (e), a 0.05% to 0.15% aqueous polyacrylamide electrolyte solution is dispersed.

17. A process according to claim 1, wherein the polyacrylamide electrolyte is an anionic polyelectrolyte.

18. A process according to claim 1, which comprises:

in step (c), diluting the aliquot to a Brix of 40°.

19. A process according to claim 1, which comprises:

in step (a), employing a 60° Brix impure sugar syrup.

* * * * *